US005722382A

United States Patent [19]

Mendoza Orozco

[11] Patent Number: 5,722,382

[45] Date of Patent: *Mar. 3, 1998

[54] LOADING PLATE FOR A REPEAT-AIR RIFLE FOR PELLETS AND AMMUNITION

[76] Inventor: Hector Mendoza Orozco, Fuego 986, colonia Jardines del Pedregal, Alvaro Obregón, Federal District, Mexico

[ * ] Notice: The term of this patent shall not extend beyond the expiration date of Pat. No. 5,666,937.

[21] Appl. No.: 612,998

[22] Filed: Mar. 8, 1996

[30] Foreign Application Priority Data

Dec. 7, 1995 [MX] Mexico ..... 955129

[51] Int. Cl.[6] ..... F41B 11/02; F41B 11/14

[52] U.S. Cl. ..... 124/51.1; 124/67; 124/82

[58] Field of Search ..... 124/51.1, 52, 53, 124/82, 66, 67

[56] References Cited

U.S. PATENT DOCUMENTS 906,309 12/1908 Schobbert ..... 124/67

FOREIGN PATENT DOCUMENTS 519142 3/1955 Italy ..... 124/67
568929 11/1957 Italy ..... 124/66
978502 12/1964 United Kingdom ..... 124/67

*Primary Examiner*—John A. Ricci
*Attorney, Agent, or Firm*—Harrison & Egbert

[57] ABSTRACT

An improved loading plate for a repeat-air rifle for pellets or ammunition including a loading plate positioned vertically in front of a compression chamber of the rifle, a first rectangular, slightly curved plate coinciding with a curvature of a barrel of the rifle, and a second rectangular, slightly curved plate coinciding with the curvature of a lower part of the rifle. The loading plate is of a rectangular shape and has a circular borehole. The loading plate has a first tongue extending from an upper part thereof so as to cover an exit of the pellets or ammunition. The loading plate has a second tongue extending from a lower part thereof having a central borehole therein so as to receive an oppressing bolt for limiting a movement of the loading plate. A spring is received by a plurality of longitudinal lodging for urging an upward movement of the loading plate.

5 Claims, 5 Drawing Sheets

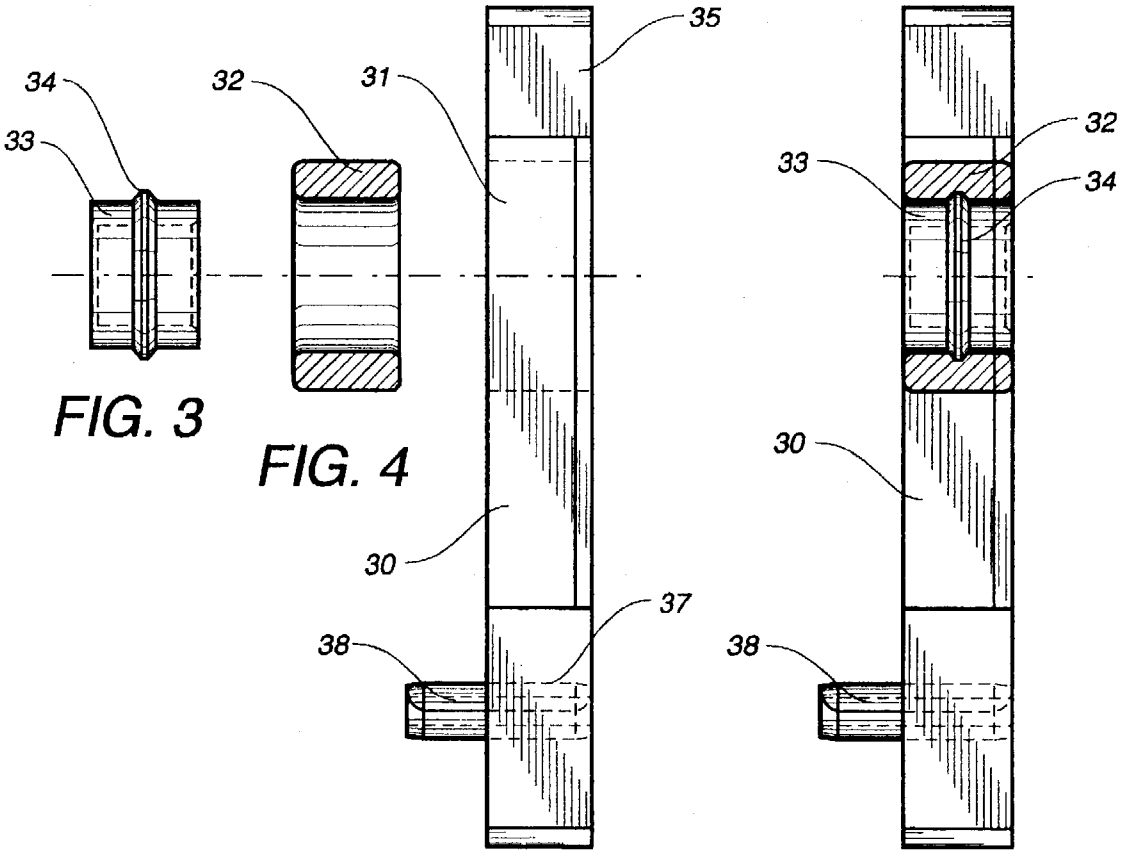
FIG. 6
FIG. 5
FIG. 4
FIG. 3
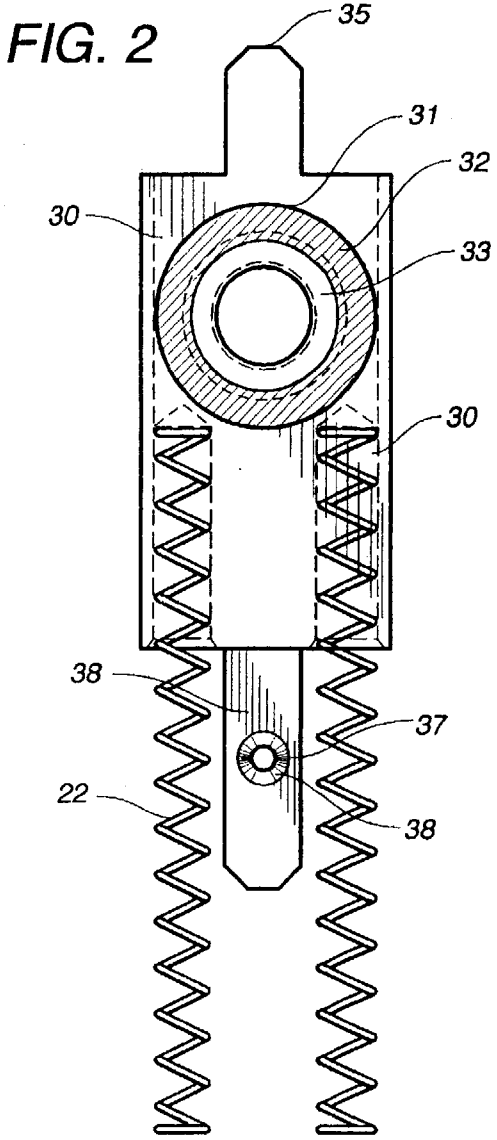
FIG. 2

LOADING PLATE FOR A REPEAT-AIR RIFLE FOR PELLETS AND AMMUNITION

SUMMARY OF THE INVENTION

A new loading plate is presented, which shall be placed on the feeding mechanism for a pellet or repeat ammunition rifle.

It has the advantage that when placed it prevents the escape of pressure from the chamber at the time of firing, thus accomplishing a greater speed of the missile, which has as a result the attainment of shots in a group.

The parts constituting the device may be summed up in that it is formed by an upper limit, consisting of a steel plate, slightly closed and with appropriate elements for its attachment to the barrel tube and having at the ends two stepped feet which shall be placed on a vertical plate, limiting its movement; a loading plate, consisting of a steel plate, placed vertically and next to the firing mechanism, having an upper tongue, and at the center a hole where an elastomeric wadding is lodged, and a ring-shaped cylinder with an outer tape, at the center of which the elastomeric wadding is fastened when introduced; a lower tongue and some pushing springs placed within longitudinal boreholes located on the plate; a lower limiter, consisting of another steel plate, slightly curved and with appropriate fastening elements, with two feet on one of its ends and next to the lower tongue of the loading plate on which the springs shall rest.

The basic purpose of this invention is to have a loading plate which prevents the escape of pressure from the loading chamber at the time of firing, with which a greater speed of the missile is accomplished.

With this, depending of course on the marksman, the missiles shall hit the target almost at the same place (grouping). This naturally is beneficial to the marksman, since he would only have to aim at the target again in order to reach the center repeatedly.

Therefore, this invention has its field of application within the accessories, artifacts and equipment for sport shooting, without this causing any type of restriction, since even though the objective was developed for this kind of rifles, it is possible to use this invention in other fields, in which case this shall be considered another application and not a new invention.

BACKGROUND OF THE INVENTION

It has been observed that preceding designs for repeat-air rifles for sport shooting based on pellets or ammunition have a loading plate which is placed on one side on the firing mechanism, this being formed by the ear, compression chamber and rifle piston, and on the other side, on the barrel.

Despite the fact that the loading plate as well as the other parts are machined, it has been seen that there is an almost imperceptible loss of pressure.

To eliminate such an inconvenience, a new loading plate has been designed, which comprises a wadding and a bushing or ring-shaped cylinder, the latter one being where the pellet or ammunition for the shot shall be received.

This way, the supports of the firing mechanism and barrel are backed up over the wadding, which is located on the loading plate, and no pressure escapes exist.

BRIEF DESCRIPTION OF THE DRAWINGS

FIG. 2 is a front view of the loading plate.

FIG. 3 is a ring-shaped cylinder or bushing with an outer protuberance at the center.

FIG. 4 is a cross section of the elastomeric wadding.

FIG. 5 is a side view and a cross section of the loading plate where the elastomeric wadding and ring-shaped cylinder or bushing shall be introduced.

FIG. 6 is a cross section of the loading plate on which the placement of the elastomeric ring and ring-shaped cylinder or bushing can be seen.

DETAILED DESCRIPTION OF THE INVENTION

Figure 1:
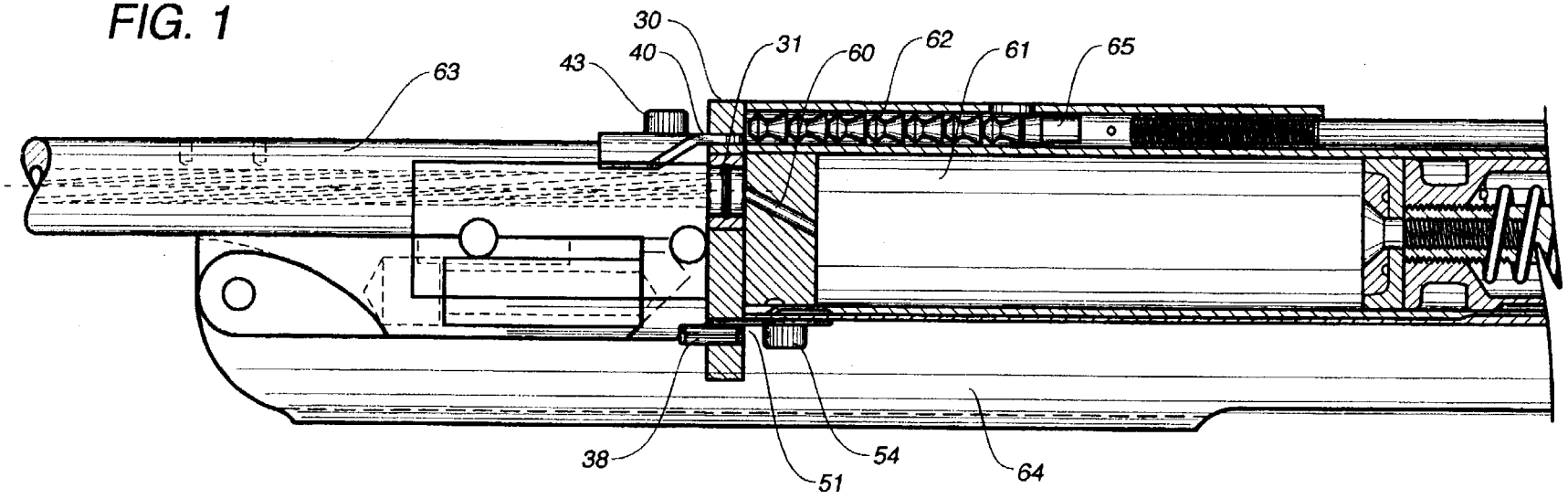
FIG. 1 is a cross section of an air sports rifle showing the loading plate.
Figure 7:
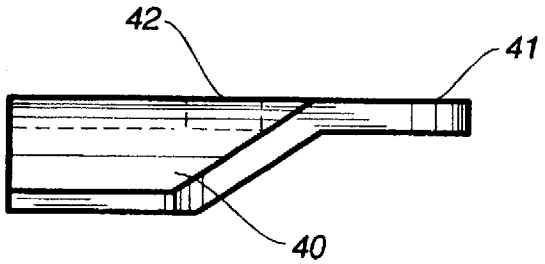
FIG. 7 is a side view of the upper limiter.
Figure 8:
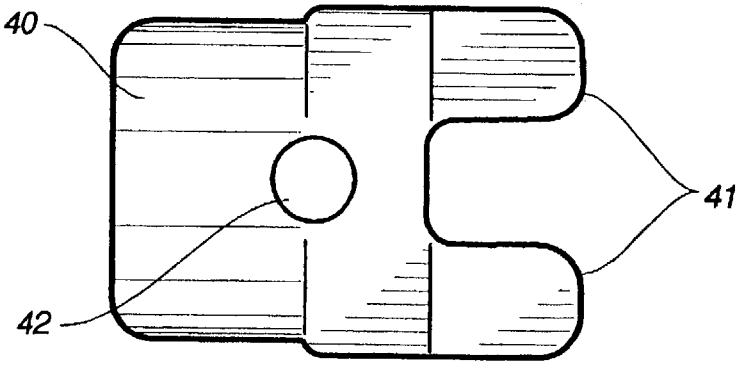
FIG. 8 is a plan view of the upper limiter.
Figure 9:
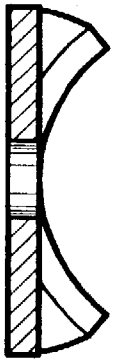
FIG. 9 is a side angle edge view of the upper limiter.
Figure 12:
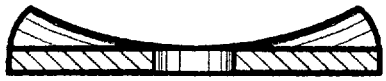
FIG. 12 is a side angle edge view of the lower limiter.
Figure 10:
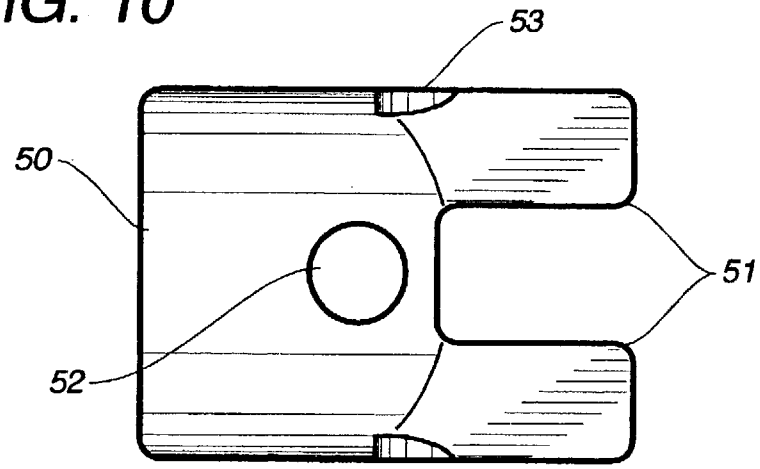
FIG. 10 is a plan view of the lower limiter.
Figure 11:
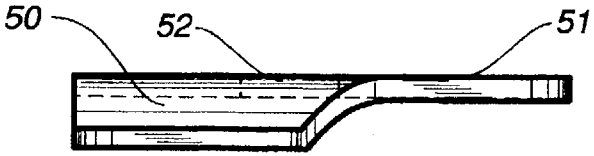
FIG. 11 is a side view of the lower limiter.
Figure 13:
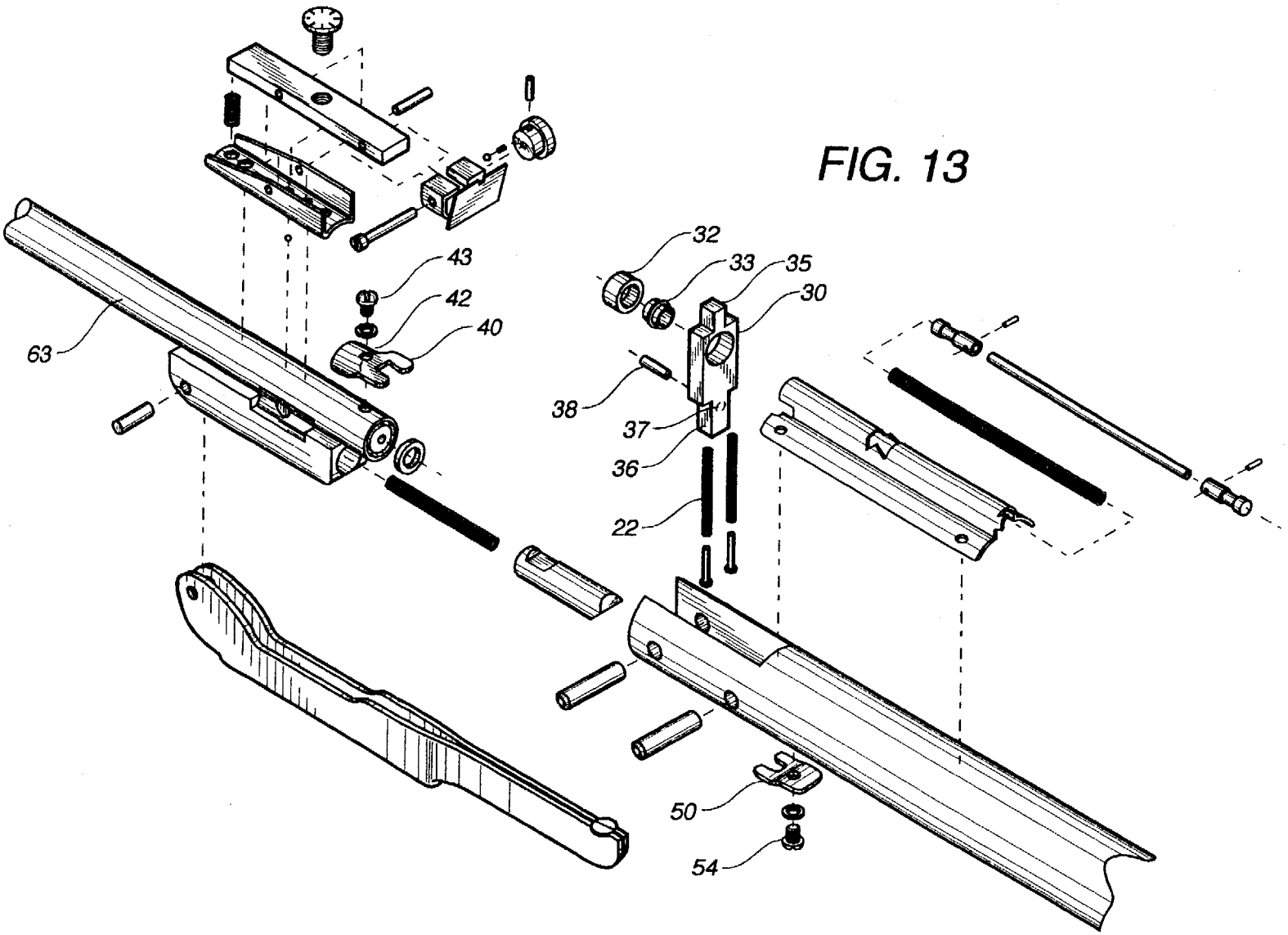
FIG. 13 is a conventional perspective dividing the invention and the other elements making up the rifle.

With reference to these figures, the loading plate for a repeat-air rifle for pellets or ammunition is formed by the combination of a loading plate (30) constituted by a plate, preferably of steel, placed vertically in front of the ear (60) and the compression chamber (61) of the gun, of a rectangular shape, carrying a central borehole (31), which make up the loading chamber of the pellets or ammunition (62), an elastomeric wadding (32) of a tubular shape as a fastening element, a ring-shaped cylinder (33) or bushing with a groove or tape (34) on its straight part towards the center and outwardly.

This ring-shaped cylinder (33) is introduced within the elastomeric wadding (32) and is fastened with the groove at the center (34).

Finally, the set of elastomeric wadding (32) and ring-shaped cylinder (33) are fixed on the central borehole (31) of the loading plate (30).

Towards the upper part of the plate (30) an upper tongue is projected (35), which precisely shall go through the hollow of a bracket of stepped feet (41) and which in turn shall cover the exit of the pellets or ammunition (62). Towards the lower part there is a lower tongue (36), carrying a central borehole (37) by which an oppressing bolt shall be installed (38), limiting the course of the loading plate (30), and having the characteristic that this lower tongue (36) is made to pass through the hollow of some curved feet (51). Longitudinal lodgings (39) are placed symmetrically towards the lower part of the plate (30), over which pushing springs are inserted (22), resting on curved feet (51) and producing a pushing of the plate (30) upwards.

For a better understanding of this plate, several of the constituent parts are presented, which work together with the loading plate (30):

An upper limiter plate (40), made up by a plate, preferably of steel, slightly curved and placed next to the curvature of the gun barrel (63), carrying a central borehole (42), which shall serve to fix itself on the gun barrel through a conventional fastener (43). Towards one of its ends, the upper limiter plate (40) has two stepped feet (41), which shall be placed on a vertical plate (30), limiting the course of the former, and an adjustment tongue (35) shall go through the hollow space of such stepped feet.

A lower limiter plate (50), made up by a plate, preferably of steel, slightly curved and placed next to the curvature of the lower part of the gun receiver (64), carrying a central borehole (51), which shall serve to fix itself on the lower part of the gun mechanism receiver (64) through a conventional fastener (52). Towards the sides, it contains adjustment grooves (53), the purpose of which is to maintain the lower limiter plate (50) on a fixed position. Towards one of its ends, the lower limiter plate (50) has two curved feet (51), over which pushing springs (22) shall sit, and an adjustment tongue (36) shall go through the hollow space.

Regarding its use, it is very simple, since once the pieces making up the device are placed, the charger (65) is filled with pellets or ammunition (62) employing the repeat-air gun. In fact, the rifle is opened and closed in order to fire on the target, and so forth.

I claim:

1. In a loading arrangement for a repeat-air rifle for pellets or ammunition, the improvement comprising:

a loading plate positioned vertically in front of a compression chamber of the rifle, said loading plate being of rectangular shape and having a central circular borehole, said loading plate having an upper tongue extending from an upper part of said loading plate so as to cover an exit of the pellets or ammunition when said loading plate is moved downward, said loading plate having a lower tongue extending from a lower part of said loading plate, said second tongue having a central borehole therein so as to receive a movement limiting bolt means for limiting a movement of said loading plate, said loading plate having a plurality of lower bores affixed symmetrically toward said lower part of said loading plate, said plurality of lower bores having spring means received therein for urging an upward movement of said loading plate;

an upper retaining plate attached to an upper part of the rifle and comprising two fingers, said fingers being positioned so as to limit upward movement of said loading plate, said upper tongue extending through a space between said fingers; and a lower retaining plate attached to a lower part of the rifle and comprising two fingers, said fingers being positioned so as to limit downward movement of said loading plate, said lower tongue extending through a space between said fingers.

2. The improvement of claim 1, further comprising:

a cylindrical elastomeric wadding means positioned within said loading plate for preventing loss of pressure from the barrel and for cushioning side movements of the loading plate upon a firing of the rifle.

3. The improvement of claim 2, said wadding means being affixed by tape to said loading plate.

4. The improvement of claim 1, said spring means for urging said loading plate upwardly when the rifle is opened.

5. The improvement of claim 4, said spring means for moving said loading plate upwardly until a loading chamber is placed in front of the pellet or ammunition.

* * * * *